US008790198B1

(12) United States Patent
Russell

(10) Patent No.: US 8,790,198 B1
(45) Date of Patent: Jul. 29, 2014

(54) TACKLING DUMMY AND SYSTEM

(76) Inventor: Colin L. Russell, Covington, GA (US)

( * ) Notice: Subject to any disclaimer, the term of this patent is extended or adjusted under 35 U.S.C. 154(b) by 163 days.

(21) Appl. No.: 13/523,966

(22) Filed: Jun. 15, 2012

(51) Int. Cl.
*A63B 69/34* (2006.01)
*A63B 69/20* (2006.01)
*A63B 69/00* (2006.01)

(52) U.S. Cl.
CPC ..... *A63B 69/345* (2013.01); *A63B 69/34* (2013.01); *A63B 69/20* (2013.01); *A63B 69/004* (2013.01); *A63B 69/00* (2013.01)
USPC ..... 473/443; 473/422

(58) Field of Classification Search
CPC .... A63B 69/345; A63B 69/34; A63B 69/004; A63B 2243/007; A63B 2243/0066; A63B 2243/0025
USPC ..... 473/443–445, 438, 439, 422; 482/83, 482/86, 87, 89, 90; D21/698, 705, 788
See application file for complete search history.

(56) References Cited

U.S. PATENT DOCUMENTS

| | | | | | |
|---|---|---|---|---|---|
| 2,153,384 | A | * | 4/1939 | Mazza | 473/443 |
| 2,532,880 | A | * | 12/1950 | Banbury | 473/443 |
| 2,749,121 | A | * | 6/1956 | Myers | 473/443 |
| 3,424,458 | A | * | 1/1969 | Hopps, Jr. | 473/443 |
| 3,464,696 | A | | 9/1969 | Hooker | |
| 3,556,523 | A | * | 1/1971 | Hooker | 473/443 |
| 3,637,210 | A | | 1/1972 | Brantley | |
| 3,659,848 | A | | 5/1972 | DePew | |
| 3,680,862 | A | * | 8/1972 | Russell et al. | 473/439 |
| 3,700,237 | A | * | 10/1972 | Kopp | 473/444 |
| 4,529,390 | A | * | 7/1985 | Levy et al. | 473/446 |
| 4,824,414 | A | * | 4/1989 | Goldblatt | 473/444 |
| 5,090,696 | A | | 2/1992 | Forrest, Sr. | |
| 5,335,906 | A | * | 8/1994 | Delker | 473/444 |
| 5,688,196 | A | * | 11/1997 | O'Neil | 473/439 |
| 5,897,466 | A | * | 4/1999 | Capach | 473/443 |
| 6,302,831 | B1 | * | 10/2001 | Henry | 482/83 |
| D469,142 | S | | 1/2003 | Forrest | |
| 6,736,738 | B1 | * | 5/2004 | Taa | 473/439 |
| 6,808,477 | B2 | * | 10/2004 | Tudor | 482/83 |
| 6,942,585 | B1 | | 9/2005 | Krause | |
| 7,288,033 | B1 | * | 10/2007 | Jordan | 473/439 |
| 7,736,248 | B2 | * | 6/2010 | Eldridge | 473/445 |
| 2008/0254950 | A1 | * | 10/2008 | Beliles | 482/83 |
| 2012/0094788 | A1 | * | 4/2012 | Hartigan | 473/445 |
| 2012/0309565 | A1 | * | 12/2012 | Ponstein | 473/443 |

* cited by examiner

*Primary Examiner* — Mitra Aryanpour
(74) *Attorney, Agent, or Firm* — Hope Baldauff, LLC

(57) ABSTRACT

A beam (20) has an inclined section (20B) and lesser-inclined or non-inclined-section (20A), the sections being supported and held at respective desired heights by cross-members (18) and posts (12). A carriage (30) rides on the lower flanges (20C1) of the beam so that a tackling dummy (36), preferably connected by a locking swivel (34) to the carriage, starts at an elevated point on the inclined section, and picks up speed and momentum as it moves along the beam to the other section, whereupon the dummy may be blocked or tackled by a player in training. The dummy may carry a football (35) for training a player to strip a ball from an opponent, may have a forwardly-projecting arm for training a player in situations where an opponent may use stiff-arm tactics, or both. Thus, the tackling dummy and system provide for realistic training for blocking and tackling.

16 Claims, 10 Drawing Sheets

TACKLING DUMMY AND SYSTEM

BACKGROUND

Tackling dummy devices are often used for training players who must contact an opposing player to stop the opposing player, drive the opposing player back, and/or to strip the ball from the opposing player. Most such devices do not realistically simulate live conditions so the training may be less useful than desired.

SUMMARY

A beam has an inclined section and lesser-inclined or non-inclined-section, the sections being supported and held at respective desired heights by cross-members and posts. A carriage rides on the lower flanges of the beam so that a tackling dummy, preferably connected by a locking swivel to the carriage, starts at an elevated point on the inclined section, and picks up speed and momentum as it moves along the beam to the other section, whereupon the dummy may be blocked or tackled by a player in training. The dummy may carry a football for training a player to strip a ball from an opponent, may have a forwardly-projecting arm for training a player in situations where an opponent may use stiff-arm tactics, or both. Realistic training for blocking and tackling is thereby provided.

DETAILED DESCRIPTION

Figure 1:
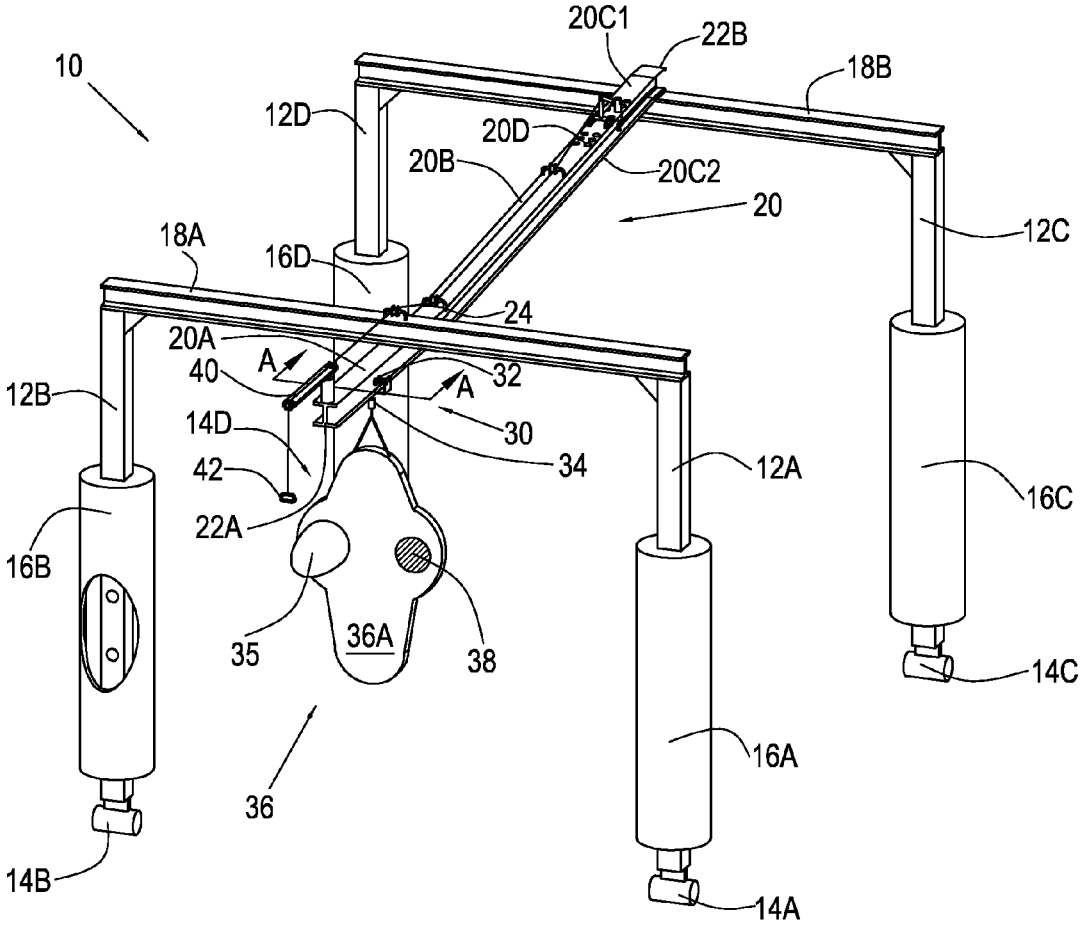
FIG. 1 is an illustration of a tackling dummy system.
Figure 1A:
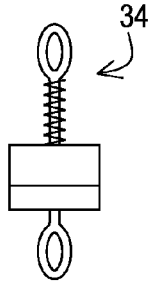
FIG. 1A illustrates an enlarged view of the locking swivel.

Referring now to the drawing, in which like numerals represent like elements throughout the several figures, FIG. 1 is an illustration of an exemplary tackling dummy system 10. FIG. 1A illustrates an enlarged view of the locking swivel 34. A beam 20 has an inclined section 20B and lesser-inclined or non-inclined-section 20A, the sections being supported and held at desired respective heights by cross-members 18A and 18B, collectively 18 and posts 12A-12D, collectively, 12. A carriage 30 rides on the lower flanges 20C2 of the beam so that a tackling dummy 36, preferably connected by a locking swivel 34 to the carriage, starts at an elevated point on the inclined section 20B, and picks up speed and momentum as it moves along the beam to the other section 20A, whereupon the dummy 36 is blocked or tackled by a player in training. The dummy 36 may carry a football 35 for training a player to strip a ball from an opponent, and may have a forwardly-projecting arm for training a player in situations where an opponent may use stiff-arm tactics. Thus, a sports opponent is realistically simulated for training for blocking and tackling.

Posts 12A-12B support cross-member 18A, and posts 12C-12D support cross-member 18B. Posts 12 are preferably, but not necessarily, vertical, or near vertical. Note that this is for convenience (for example, cost, size) and/or for safety (for example, to minimize the "footprint" of the system on a playing or practice field). For example, it may be desirable for the posts 12 to be at an angle from vertical for better stability when the system 10 is being moved.

Preferably, but not necessarily, the posts 12A-12D are mounted on wheel or roller assemblies 14A-14D, respectively, collectively, assemblies 14, so that the system 10 can be conveniently moved from one location to another on the playing or practice field.

Also, for reasons of safety, the posts 12A-12D are preferably, but not necessarily, covered with a protective layer, mat, mattress, foam or other appropriate material 16A-16D, respectively, so as to minimize the likelihood of serious injury if a player runs into a post 12.

The cross-members 18 are mounted to the tops of the posts 12 by any convenient method. For example, the posts 12 could be welded or bolted to the cross-members 18. The cross-members 18 may be any convenient and desired length. In one embodiment, the length of a cross-member 18 is approximately ten feet. The length is not critical but, if they are too long the system 10 will be large and bulky, and require more space for storage. Conversely, if they are too short the system 10 may be unstable and prone to topple, and/or a player may be more likely to inadvertently impact the posts 12 and be injured.

The cross-members 18 are attached by any convenient method to a long beam 20. For example, the long beam 20 could be welded or bolted to the cross-members 18. For safety reasons, the posts 12 are tall enough that the lower surface or edge of the long beam 20, the cross-member 18, and the locking swivel 34, are above the height at which a player's head or helmet might inadvertently make contact. This height is not critical but, in one embodiment, the height above ground of the lower surface of the long beam 20 is approximately eight feet. The long beam 20 preferably has two sections 20A, 20B, and two distal, opposing ends 22A, 22B, respectively. As shown, cross-member 18B is attached to long beam 20 at section 20B, preferably but not necessarily near the end 22B. Also as shown, cross-member 18A is attached to long beam 20 at section 20A, preferably but not necessarily away from the end 22A. Preferably, but not necessarily, section 20A is approximately level, or horizontal, and section 20B is at an angle with respect to horizontal. The angle of section 20A may be 0 degrees or may be inclined slightly so that, once the dummy 38 passes the transition point 24, the dummy 38 does not lose speed, or does not lose as much speed as if section 20A were level, or slightly gains speed. The angle of section 20B is preferably in the range of 5 to 30 degrees and, more preferably, is approximately 10 degrees. This angle is not critical—more angle results in more speed and momentum, less angle results in less speed and momentum. The angle may therefore be chosen to result in a desired effect.

The two sections 20A, 20B may be formed from a single beam which is bent or curved at or near the transition point 24. Alternatively, the two sections 20A, 20B may be two distinct beams which have distal ends 22A, 22B, and interior ends (not shown), the interior ends of which are connected at or near a transition point 24 by any convenient method, such as welding or by bolting. The sections 20A, 20B are shaped and/or connected so that the carriage 30 can make a relatively smooth transition from one section to another section. Preferably, the length of long beam 20 is approximately fifteen feet, with section 20B being ten feet and section 20A being five feet. The area along which the transition from inclined to non-inclined occurs is conveniently referred to herein as the transition point 24. Preferably, but not necessarily, the long beam 20 is connected to the cross beam 18A at or near the transition point 24. These dimensions are not critical but if the beam 20 is too long then the system 10 may be difficult to move or store, and if the beam is too short then the desired speed and momentum effect and training may not be acquired. Also, if the section 20A overhangs too much past the connection point to the cross-beam 18A, or if the section 20B is too short, then the system 10 may be unstable and tend to fall forward under certain conditions.

An exemplary carriage 30 is shown. The construction of the carriage 30 is not critical. Carriage 30 is moveable along the length of long beam 20 and preferably has a plurality of wheels 32 which ride on the lower flanges 20C2 of the long beam 20. Carriage 30 supports tackling dummy 36 which may be connected thereto in any convenient manner. Preferably, but not necessarily, carriage 30 and tackling dummy 36 are connected via a locking swivel 34. The locking swivel 34 has a preferred orientation such that the front 36A of the tackling dummy 36 faces "forward", that is, toward the end 22A of long beam 20. Locking swivel 34 preferably allows the tackling dummy 36 to rotate when hit, but maintains the tackling dummy 36 in, and returns the tackling dummy 36 to, a forward facing position otherwise. Locking swivel 34 may have more than one "locked" or preferred orientation. For example, the swivel 34 may also have a locking orientation at ±30 degrees, so as to simulate the player approaching the ball carrier (dummy 36) at an angle rather than head-on.

The tackling dummy 36 may be any convenient size and shape. Preferably, but not necessarily, the dummy 36 has a size and shape approximating at least the torso of an opposing player and, even more preferably, the head and helmet, of the opposing player. This allows the player to become accustomed to tackling an object with the shape of an opposing player, rather than an object with the shape of, for example, a cylinder, such as a punching bag. The tackling dummy preferably, but not necessarily, has a different thickness and shape when viewed from the front than when viewed from the side. Also, preferably, but not necessarily, the tackling dummy 36 has a weight which approximates the weight of an opposing player in full gear. This weight may vary, such as but not limited to, from around 100 pounds to 250 pounds or more, depending upon the sport of interest and also the level of the sport. For example, the weight of a wide receiver on a high school football team is generally less than the weight of a lineman on a professional sports football team. The system 10 preferably holds the tackling dummy at a height to approximate an opposing player, such as, but not limited to, 5 feet, 6 inches to 6 feet, 6 inches. In one embodiment, the top of the head of the tackling dummy 36 is at a height of approximately 5 feet, 10 inches, and the tackling dummy 36 has a weight of approximately 200 pounds.

In addition, the tackling dummy 36 preferably, but not necessarily, has two voids 38 toward the outer edges. The voids 38 may be recessions or may be holes which traverse the dummy 36. These voids are the size and shape necessary to hold a ball (not shown) of the type involved for the particular sports of interest. For example, the voids 38 could be designed to hold a football 35. The shape and dimensions of a void 38 preferably hold the ball securely enough that the ball will not come loose just from a player tackling the dummy 36, but will come loose when the player strikes the ball hard. This provides practice for the player to strip the ball from the opposing player and thereby cause a fumble.

Figure 2:
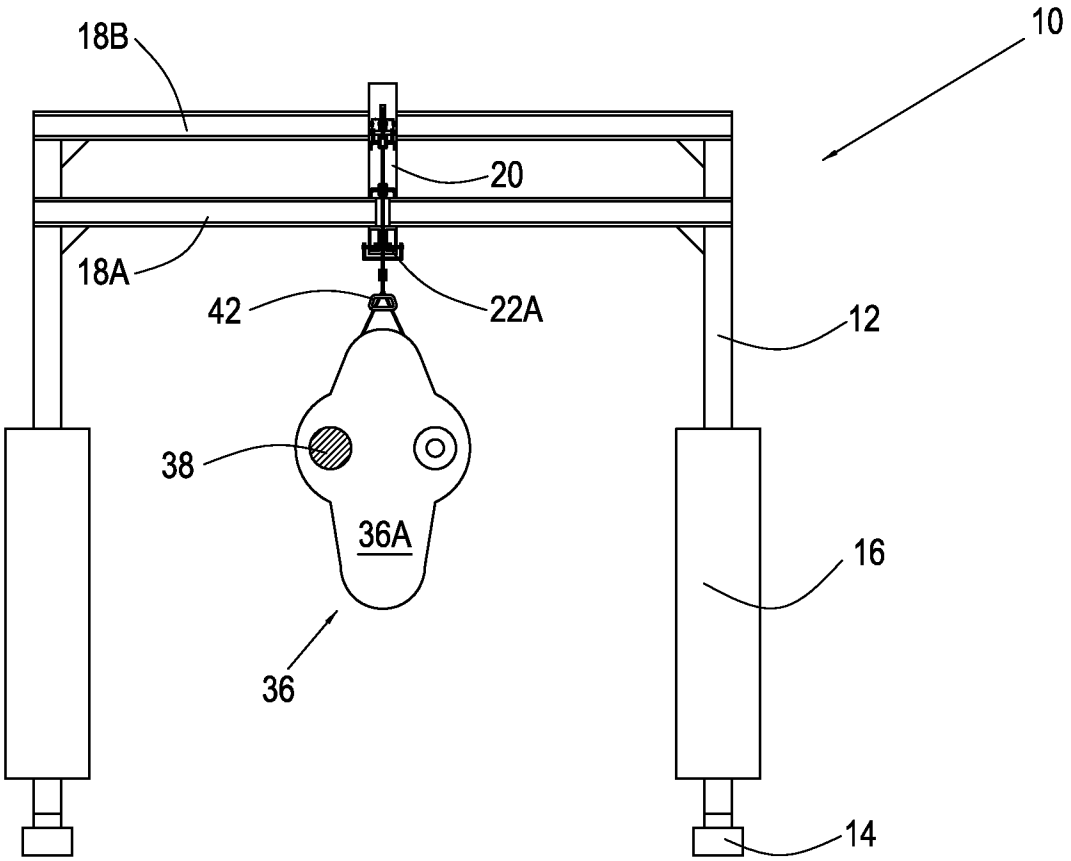
FIG. 2 illustrates a front view of the tackling dummy system.
Figure 3:
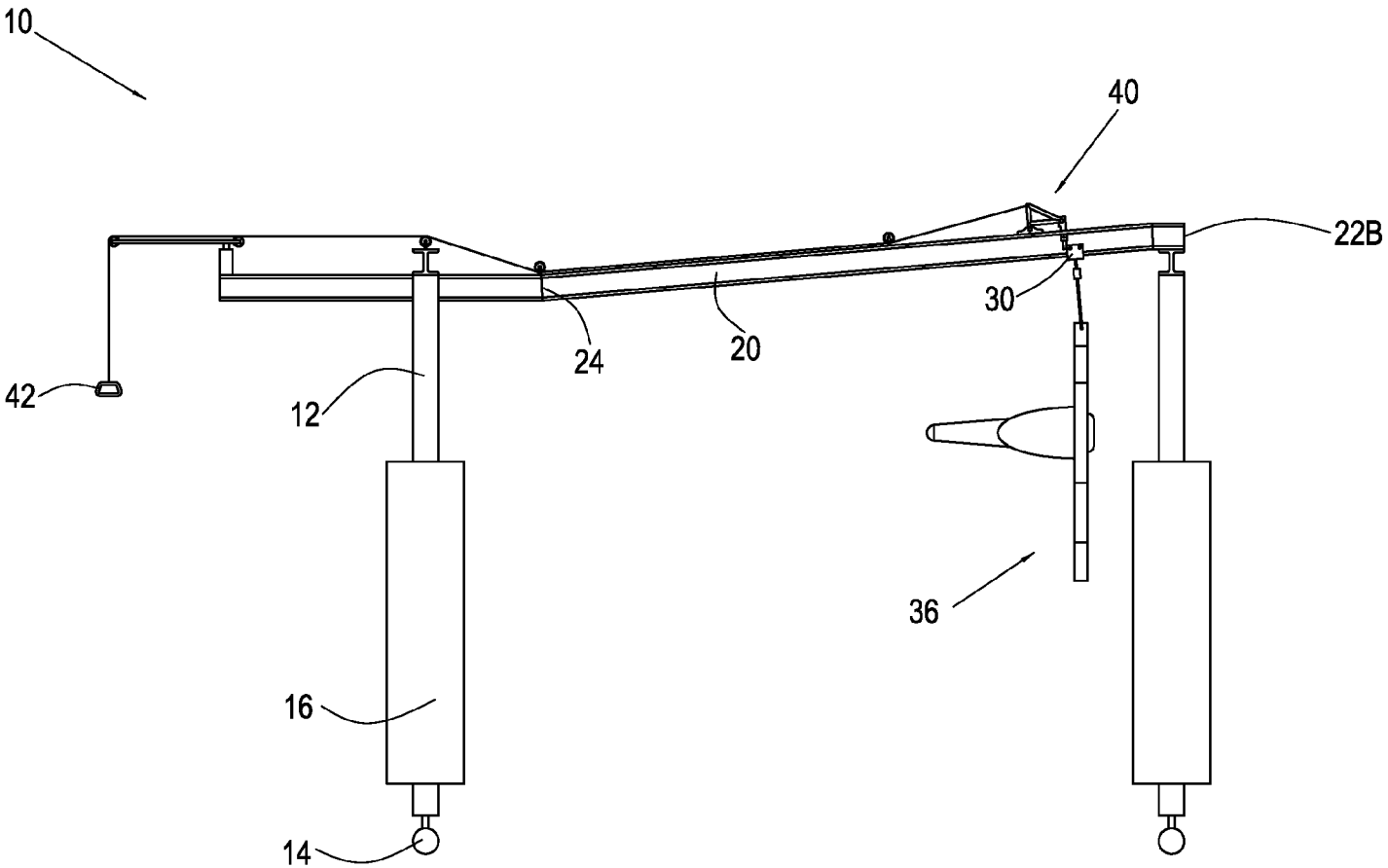
FIG. 3 illustrates a side view of the system and shows the release mechanism.

FIG. 2 illustrates a front view of the system 10, and FIG. 3 illustrates a side view of the system 10. A release mechanism 40 restrains the carriage toward the higher end 22B of long beam 20, that is, toward the rear end 22B. When the handle 42 is pulled the release mechanism 40 then allows the carriage 30 (and tackling dummy 36) to move by gravity toward the front end 22A.

Consider now the effect provided by the system 10. The carriage 30 and dummy 36 start at an elevated position toward the rear end 22B. When the handle 42 is pulled the carriage 30 and dummy 36 will start to roll downhill, that is, away from rear end 22B and toward front end 22A. The dummy 36 thus gains speed and momentum on section 20B and then, after passing transition point 24, begins coasting. When the player (not shown) tackles or blocks the dummy 36, the player must hit the dummy hard enough, or the player must stand ground firmly enough, to overcome the momentum of the dummy in order to bring the dummy to a stop. The player may also continue to "drive" so that the dummy is pushed back on the beam section 20A and even slightly up on section 20B.

In addition, the player must make solid contact near the vertical center of the dummy 36. An off-center hit will preferably cause the dummy 36 to rotate on the locking swivel 34, thus causing the player to go to one side—indicating that the tackle was not successful. Further, the player is instructed to attempt to strip the ball—that is, to knock the ball out of the hole 38—when the player tackles the dummy.

Preferably, but not necessarily, the release mechanism may be located and/or relocated at various positions along the length of long beam 20 to provide for different levels of desired momentum for the dummy 36. For example, releasing the dummy 36 from a point near the end 22B will provide more speed and momentum than releasing the dummy 36 from a point just to the rear of the transition point 24. Of course, it may also be desirable for the dummy to have little or no momentum, such as to simulate a quarterback who is standing in the pocket looking for an opportunity to pass the ball. In that case it may be desirable for the release mechanism to be located on section 20A or on section 20B very near the transition point 24, or even for the release mechanism to be disengaged, such as by pulling on the handle 42. It may also be desirable to rotate the dummy 36 to a locking angle other than straight ahead, so as to simulate approaching a quarterback from the side or rear.

It will be appreciated that a player will get substantially a full body workout using the system, especially when used in conjunction with the tackling dummy disclosed herein. The player will have to use chest, abdomen, back, arm, and leg muscles in order to stop the dummy, move the dummy backward on the beam, and strip the ball from the dummy. Thus, the system is not limited to football training, but can be used for body conditioning in general.

Figure 4:
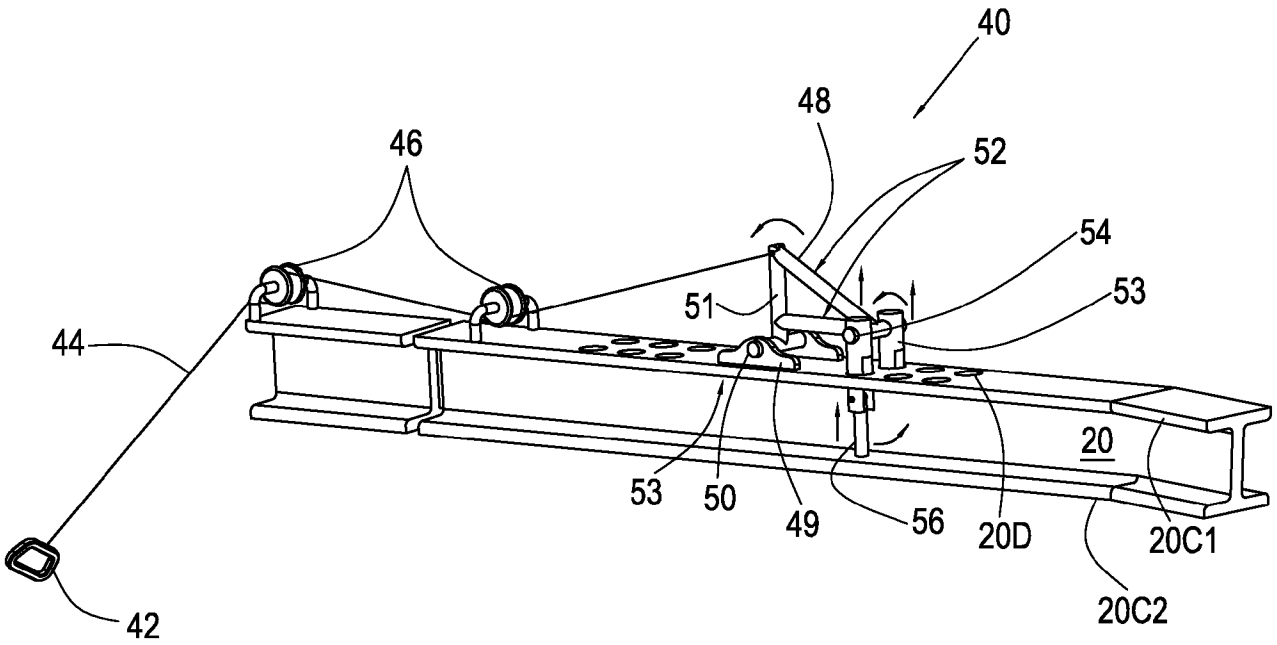
FIG. 4 is an illustration of an exemplary release mechanism.

FIG. 4 is an illustration of an exemplary release mechanism 40. The upper flanges 20C1 of beam 20 have a plurality of holes 20D therein. The exemplary release mechanism 40 has a handle 42, which is connected to a release wire 44, which is connected to a lever arm assembly 48, which is connected to one or more restraining pins 56, which fit into the holes 20D of the upper flange 20C1. When the one or more pins 56 is in a lowered position, it will block the carriage 30 and prevent it from moving, thus holding the tackling dummy 36 in a desired position, such as, for example, midway on section 20B. When the handle 42 is pulled, the motion is translated by the lever arm assembly 48 into an upward movement of the pins 56, thereby releasing the carriage 30 and tackling dummy 36. Gravity then moves the carriage and tackling dummy downward and forward.

When the dummy 36 reaches the end of section 20A, or is stopped by a player, then the dummy 36 may be manually pulled back up to the starting point, the pins 56 deflect (FIG. 4A) so that the carriage 30 can pass by, and then the pins 56 return to a blocking position, whereby the carriage 30 is then held at the starting position and is ready for the next player.

One or more pulleys 46 are used to guide and/or change the direction of motion of the release wire 44 when the handle 42 is pulled. The lever arm assembly 48 has a base 49 with holes (not numbered) in it to accommodate an axle 50, has a post 51 which is rotatably connected by the axle 50 to the base 49, and has lever arms 52 which connect the post 51 to the pins 56. The end of the lever arms 52 have a hole (not numbered) and the top of each pin 56 has a hole (not numbered), so that the pins 56 are rotatably connected to the lever arms 52 via a pin axle 54. Thus, when the handle 42 is pulled, the wire 44 pulls on the post 51, the post 51 rotates or deflects around the axle 50, and the direction of the motion is translated into an upward motion of the pins 56.

Preferably, base 49 has pins 53 on bottom which project downwardly through holes 20D. This allows the release mechanism 40 to be conveniently moved further up, or further down, on the section 20B, to achieve a desired momentum and speed of the tackling dummy 36. Thus, to move the release mechanism 40, the base 49 would be pulled upward and the pins 53 and 56 would be pulled out of the holes 20D, the mechanism would be moved to a new, desired position, the pins 56 would be reinserted into different holes 20D, and the base 49 would be pushed onto the beam 20 so that the pins 53 would be reinserted into different holes 20D. Alternatively, the base 49 may not have pins 53 but, instead, bolts and nuts (not shown) may be used to affix the base 49 to the beam 20.

A pulley 46 preferably, but not necessarily, has pins (not shown) or bolts and nuts (not shown) which fit into the holes 20D and allow the pulley 46 to be moved, as necessary, when the release mechanism 40 is moved. Preferably, but not necessarily, a pulley 46 has a shield (not shown), or very deep flanges (not shown) to keep the release wire 44 from being accidentally disengaged from the pulley 46. Also, the foremost pulley 46 may, if desired, be at an angle such as but not limited to, 45 degrees, so that the pulley 46 will accommodate the handle 42 being pulled forward or downward with respect to beam 20, thereby conveniently allowing the player to pull the handle and release the dummy 36, and also will accommodate the handle 42 being pulled to the side and downward, thereby conveniently allowing a coach or a different player, standing off to the side, to pull the handle and release the dummy 36. Of course, a different release mechanism, or variations on the above release mechanism, may be used, if desired.

Figure 4A:
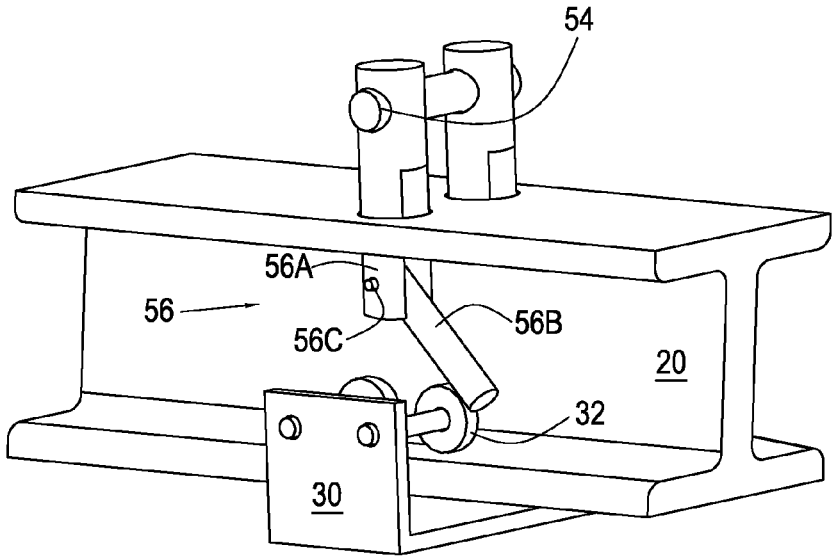
FIG. 4A is an illustration showing details of an exemplary release mechanism.

FIG. 4A is an illustration showing details of an exemplary release mechanism. The pin 56 has a tubular channel section 56A, which has a slot (not numbered) along one side thereof. The section 56A has the hole (not numbered) for the pin axle 54, and also has a hole (not numbered) for bypass axle 56C. The pin 56 also has a one-way tang 56B, which is mounted to the channel section 56A by the bypass axle 56C. Assume first that the carriage 30 is to the left of the picture. In that case the tang 56B will fall into the slot in channel section 56A as a result of gravity or, optionally, a spring mechanism. When the carriage 30 is then moving in the direction of the large arrow on FIG. 4A, a wheel 32 of the carriage 30 will push the tang 56B so that the tang 56B will rotate upwardly and out of the way of the wheel 32. Then, once the wheel 32 has passed, the tang 56B will fall back into the slot in channel section 56A. Now, if the carriage attempts to move in a direction opposite to the large arrow, then the tang 56B will block the wheel 32, so that the carriage 30 and tackling dummy 36 are held in the desired starting location. If the handle 42 is then pulled, the pin 56 will be pulled upward and, once pulled far enough, the wheel 32 will be able to pass underneath the tang 56B, so the carriage 30 and the tackling dummy 36 will begin to roll down the long beam 20 by virtue of gravity. As mentioned, a different release mechanism, or variations on the above release mechanism, may be used, if desired.

Figure 5:
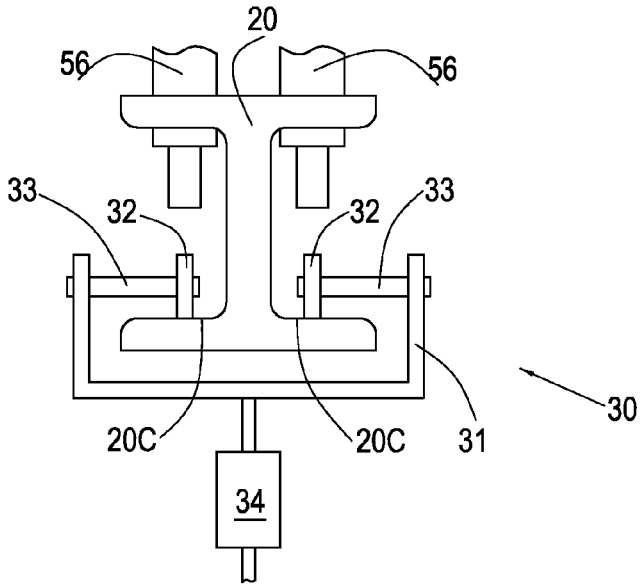
FIG. 5 is a cutaway view along lines A-A of FIG. 1, and illustrates an exemplary carriage and pins.

FIG. 5 is a cutaway view along lines A-A of FIG. 1, and illustrates an exemplary carriage 30 and pins 56. The wheels 32 are connected by axles 33 to the carriage 30. The wheels 32 rest upon, and ride along, the lower flanges 20C2 of the beam 20. Additional wheels (not shown) or other devices may be used, if desired, to keep the carriage 30 centered with respect to the beam 20 so that the carriage body 31 does not rub against the flanges 20C1. The pins 56 are shown in the raised (released) position.

Figure 6A:
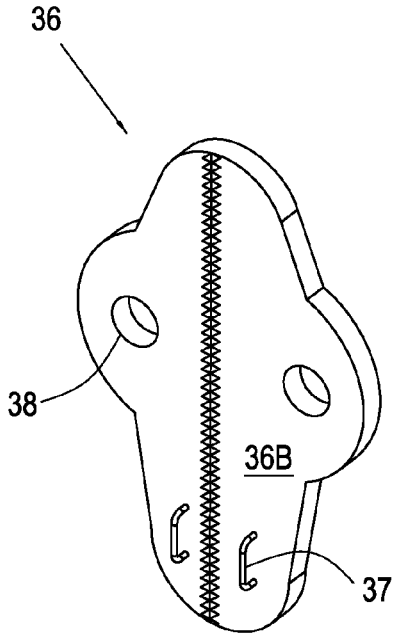
FIG. 6A is an illustration of one exemplary embodiment of a tackling dummy.

FIG. 6A is an illustration of one exemplary embodiment of a tackling dummy 36. In this embodiment shown, there are two optional handles 37 shown on the back side of the dummy. These are to simulate, for example, the thighs of an opponent and give the player something to grab and hold while practicing tackling the opponent and driving the opponent backwards.

Figure 6B:
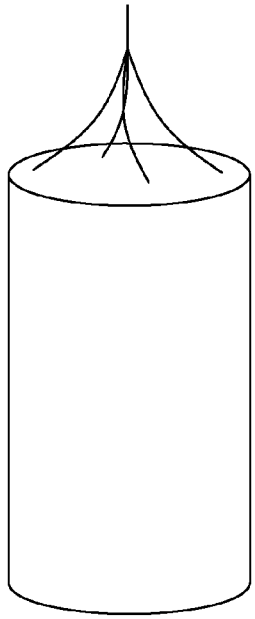
FIG. 6B illustrates the use of a punching bag as a tackling dummy.

FIG. 6B illustrates the optional use of a punching bag as a tackling dummy 36. Although it is preferred that the tackling dummy be made specifically for that purpose, an alternative is to use a punching bag, or some other heavy, durable but resilient object, as the tackling dummy. If a punching bag is used, then it should preferably have a padded, vinyl (or other durable) covering which is also configured to provide the forwardly-projecting "arms" and/or to provide the voids for holding the ball. FIG. 6A shows an example of a punching bag being used with a covering for the tackling dummy, and also shows, in exaggerated form, the stitches used to close the cover around the dummy.

Figure 7:
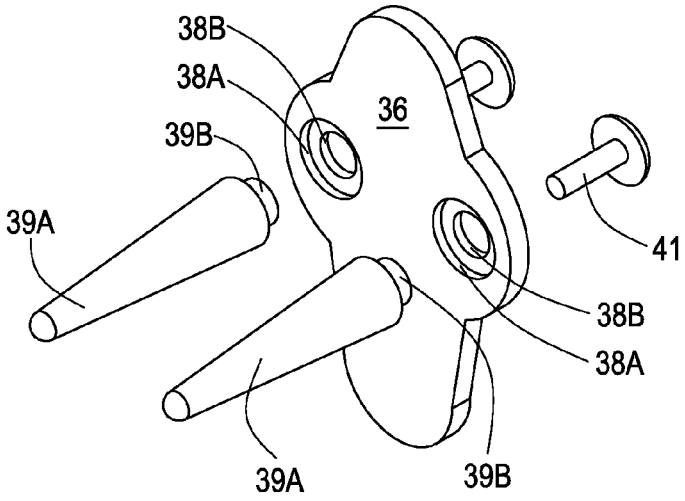
FIG. 7 illustrates an embodiment of a tackling dummy with one or more forwardly-projecting arms.

FIG. 7 illustrates an embodiment of a tackling dummy 36 with one or more forwardly-projecting arms 39A. In this embodiment, the void 38 preferably has at least one recession area 38A, and a hole 38B which goes through the dummy 36. An arm 39A is placed in the void 38, the arm 39A having an extension 39B which goes at least partially into, and may completely fill, the hole 38B. A cap 39C is then screwed onto, or is otherwise preferably reversibly attached to, the extension 39B. The arm 39A thus simulates an opponent using a stiff-arm tactic. There may be two arms 39A, or there may only be one arm 39A in one recession 38, such as when a football (not shown) is placed in the other void 38. Preferably, a void 38 is configured to accommodate both a ball, such as a football, and an arm, so that the tackling dummy can be readily configured, using the same void, to be either a ball carrier and/or an opponent using a stiff-arm tactic.

A tackling dummy may be any desired color. For example, a tackling dummy could have the school colors on it. Alternatively, a tackling dummy could have an opponent's colors in order to inspire the players. Preferably, the tackling dummy is made using an interior part, such as a punching bag, and an exterior part, such as the covering. In that case, there could be several different coverings, each one with a different color scheme for a respective different opponent.

Figure 8A:
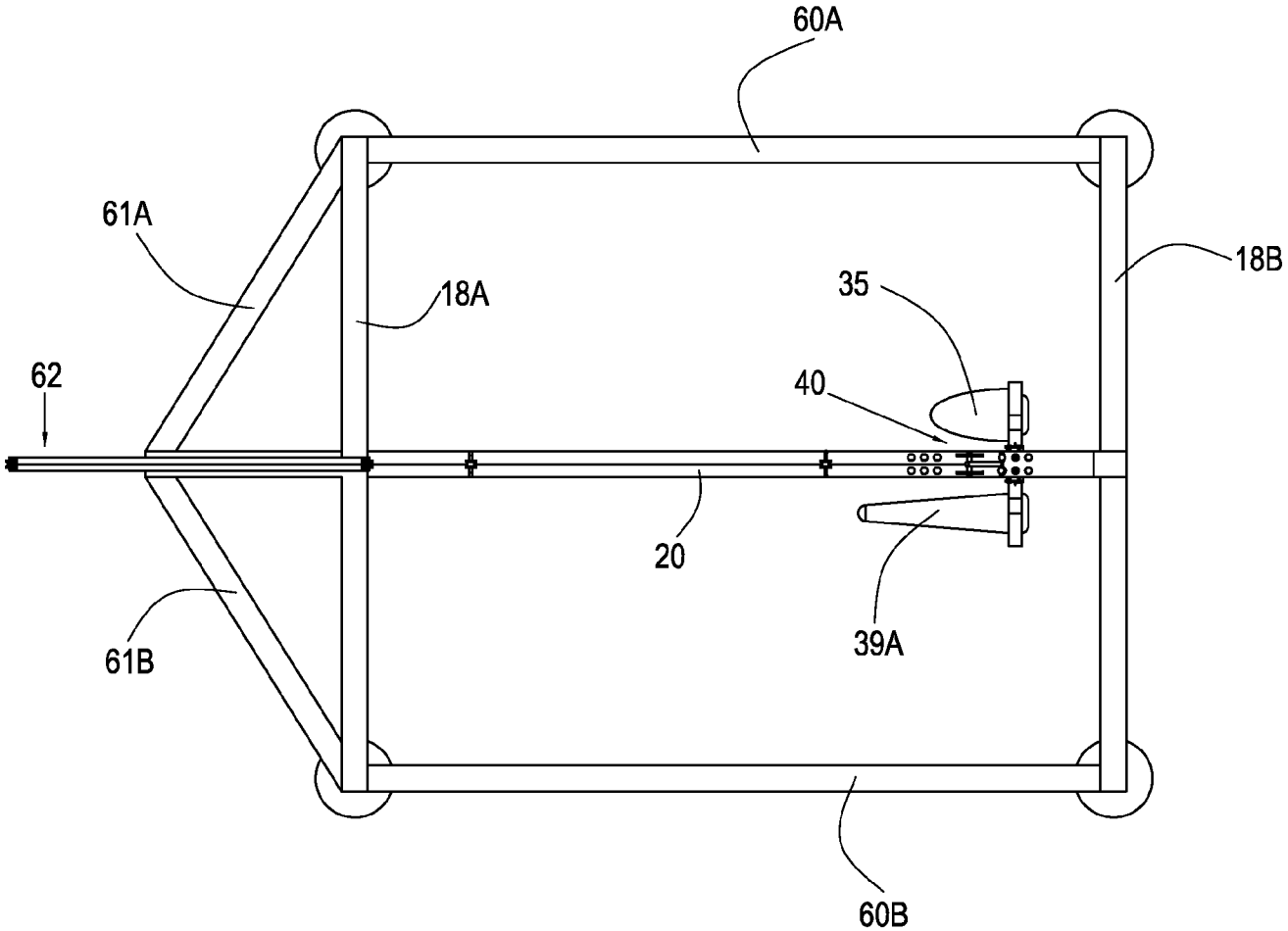
FIGS. 8A-8C illustrate an alternative embodiment of a tackling dummy system, including an optional swing arm.
Figure 8B:
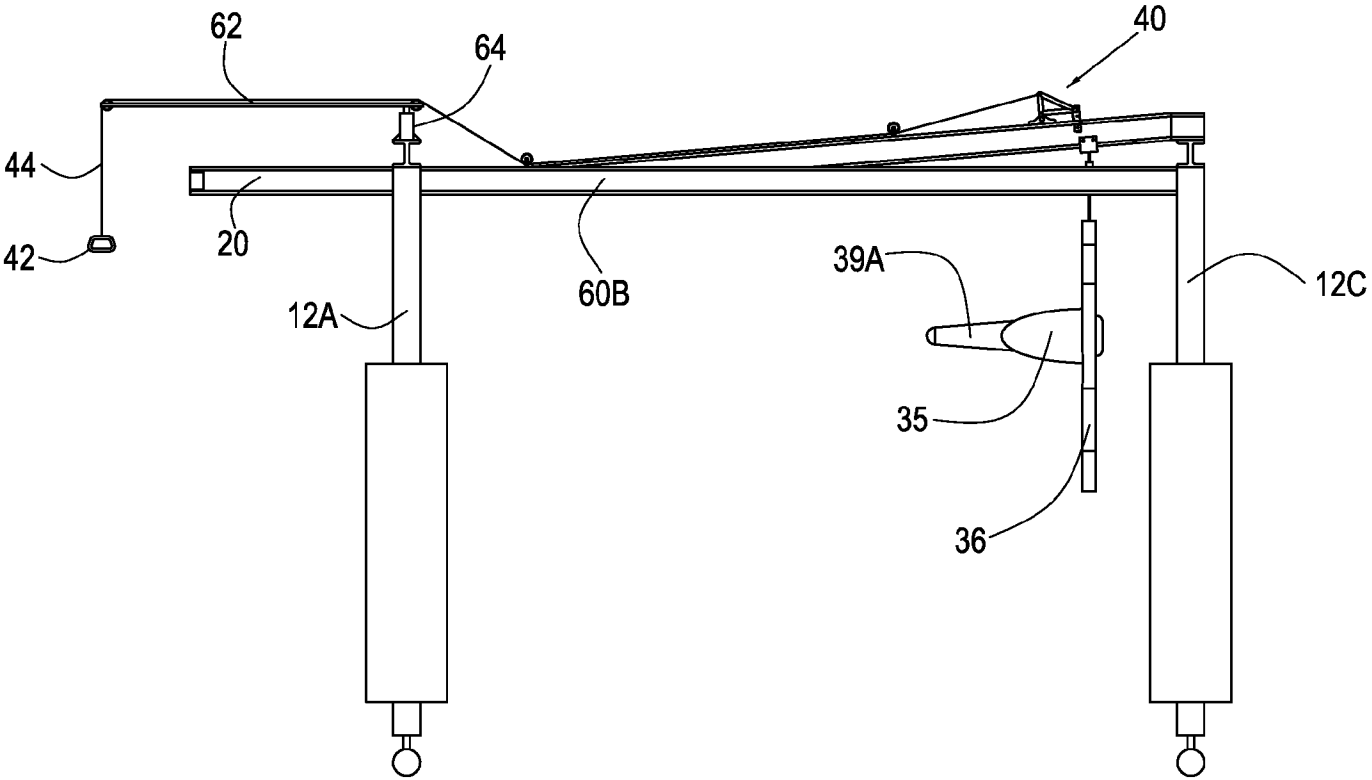
Figure 8C:
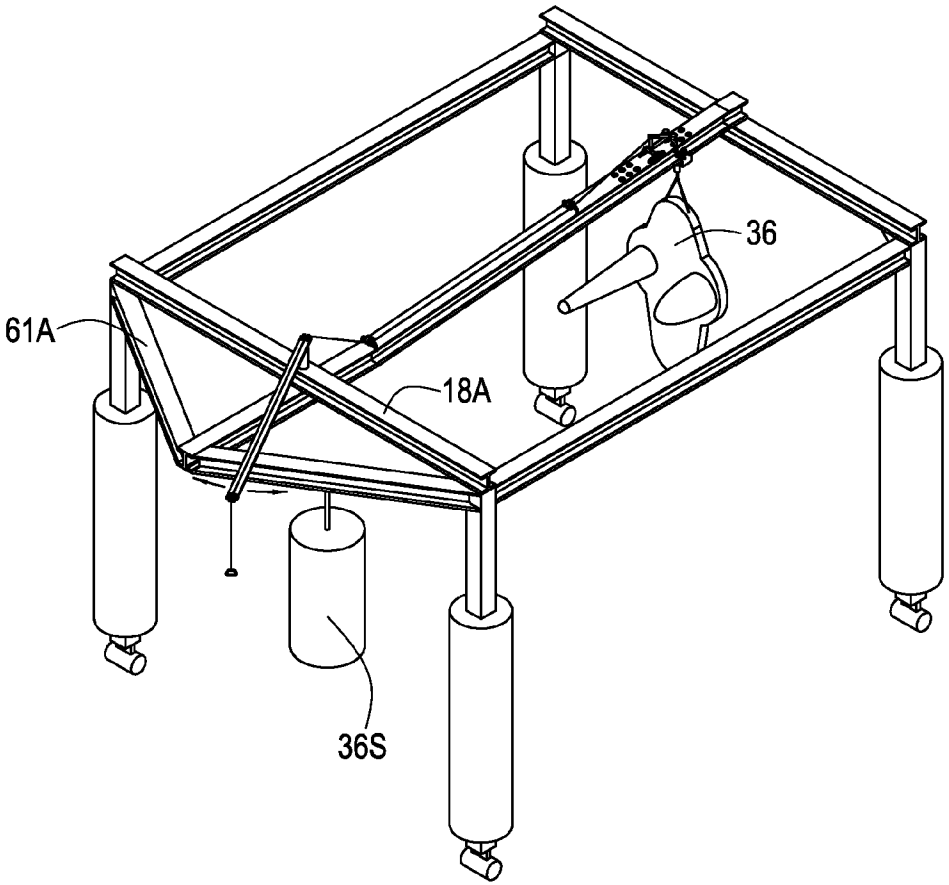

FIGS. 8A-8C illustrate alternative embodiments of a tackling dummy system 10. Optional side beams 60A, 60B, and front beams 61A, 61B, make the structure more rigid. In addition, optional, stationary tackling dummies, such as dummy 36S, may be attached to the beams 60, 61, in any desired manner and in any desired location. For example, a dummy 36S may be attached to beam 61A as shown in FIG. 8C. The player is then instructed to drive through dummy 36S to reach the moving dummy 36. This provides a player with training on overcoming one or more offensive line personnel, such as the tackle or guard in a football game, in order to reach the ball carrier. Preferably, but not necessarily, the optional dummies 36S are attached to a beam 61A, 61B using a locking swivel, as described earlier. A dummy 36S may also have none, one, or two projecting arms, as described above.

An optional swing arm 62 is preferably rotatably mounted to the cross-member 18A by use of a coupling 64. In this alternative embodiment, the release wire 44 is routed along the swing arm 62 to the handle 42. This allows a coach, trainer, or other person, such as another player, to be to the side of the long beam 20 so that the player has more latitude in rushing and tackling the dummy 36.

Figure 9:
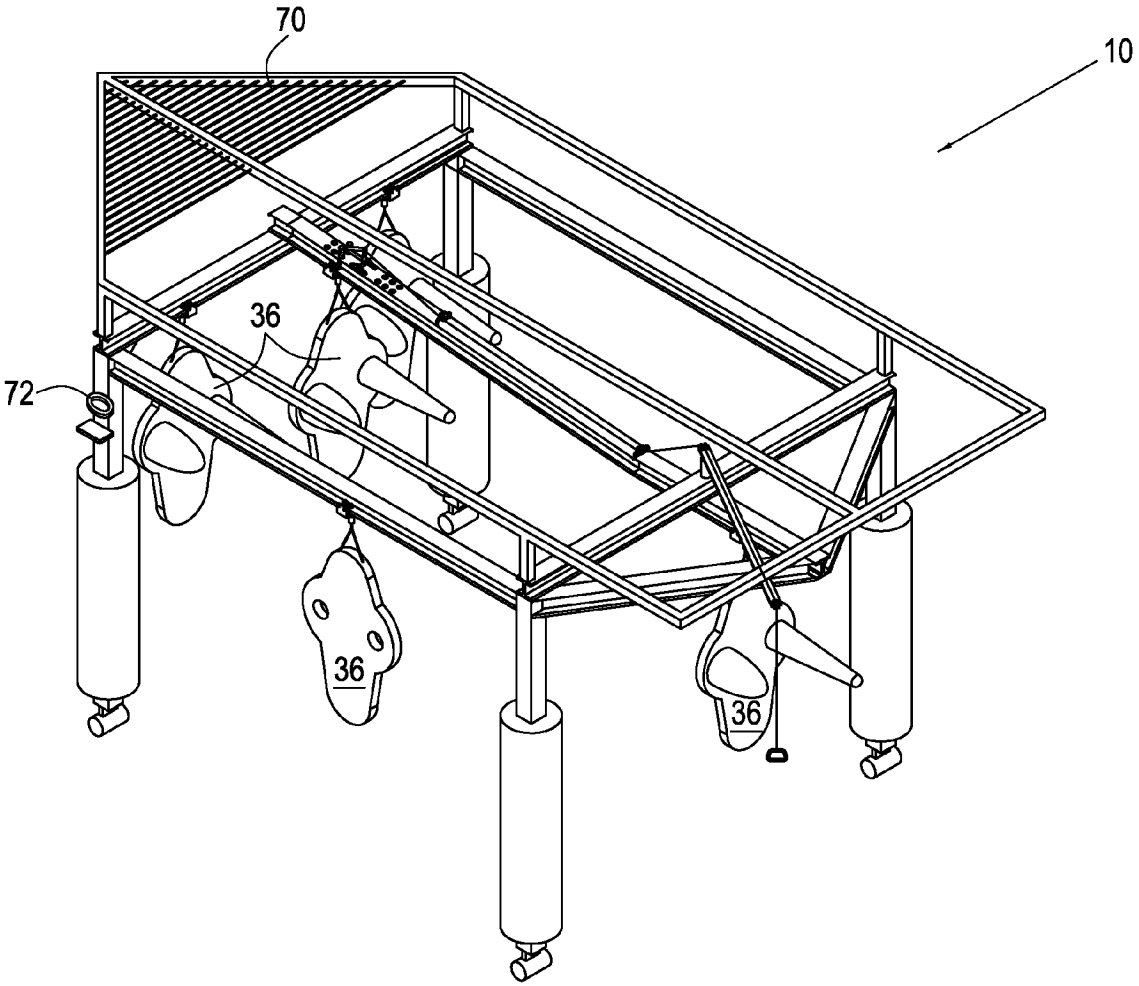
FIG. 9 illustrates another alternative embodiment of a tackling dummy system.

FIG. 9 illustrates another alternative embodiment of a tackling dummy system. In this alternative embodiment, a cover 70 is added over the system 10. The cover provides shade which provides relief from the sun (or rain) to players, coaches, trainers, etc., and also keeps the various components, such as the tackling dummy, from becoming uncomfortably hot, such as when there is a strong sun and the tackling dummy is a dark color. The cover also protects moving parts such as, but not limited to, the release mechanism from rain, snow, etc. The cover may be conveniently attached to, for example, the posts 12 and/or the beams 18, 20, 60, and/or 61.

In another embodiment, a cooler holder 72 is attached to the frame of the system 10, such as, but not limited to, being attached a post 12. The cooler holder may be, for example, a shelf or platform for holding an ice chest with drinks or a water barrel, or may be a shelf and/or brackets designed to hold a water barrel. This provides a convenient way for players, coaches and trainers to stay hydrated while on the practice field.

The subject matter described above is provided by way of illustration only and should not be construed as limiting. Various modifications and changes may be made to the subject matter described herein without following the exemplary embodiments and applications illustrated and described herein.

Although the subject matter presented herein has been described in language specific to the various disclosed embodiments, the appended claims are not necessarily limited to the specific features, acts, or components described herein. Rather, the specific features, acts and components are disclosed as example forms of implementing the claims.

The invention claimed is:

1. A tackling dummy system, comprising:

a plurality of support members;

first and second lateral members supported by the support members;

a longitudinal member having a first section and a second section, the first section being attached to and supported by the first lateral member, the second section being attached to and supported by the second lateral member;

a carriage moveably mounted on the longitudinal member;

wherein the longitudinal member comprises a first beam and a second beam, the first and second beams being joined together lengthwise, one section being at an angle of approximately zero degrees and another section being inclined at an angle of approximately 10 degrees with respect to the first section;

wherein the longitudinal member comprises a beam having at least one upper flange having at least one hole therein, a release mechanism, attached to the longitudinal member, to selectably prevent the carriage from moving in at least a predetermined direction on the longitudinal member, the release mechanism comprises:

a handle;

a lever arm assembly attached to the longitudinal member;

a wire to connect the handle to the lever arm assembly;

at least one pin, connected to the lever arm assembly, which projects through the at least one hole in the at least one upper flange, the at least one pin having an extended position which prevents the carriage from moving in at least one direction along the longitudinal member, and which has a retracted position which allows the carriage to move in the at least one direction along the longitudinal member;

a tackling dummy; and a hanger to connect the tackling dummy to the carriage.

2. The tackling dummy system of claim 1, wherein the first section is at an angle is approximately zero degrees.

3. The tackling dummy system of claim 1, wherein the second section is inclined at an angle of approximately 10 degrees with respect to the first section.

4. The tackling dummy system of claim 1, wherein a first pair of vertical members support the first lateral member at a first height, and a second pair of vertical members support the second lateral member at a second height, so that one end of the second section is higher than the first section.

5. The tackling dummy system of claim 1 wherein the at least one pin has a hole therein, and wherein the lever arm assembly comprises:

a base with a hole, the base being attached to the longitudinal member;

a post with a hole and a lever arm, the lever arm having a hole therein toward a distal end with respect to the post;

an axle, inserted into the hole in the base and into the hole in the post, whereby the post is rotatably attached to the base; and a pin axle, inserted into the hole in the pin and into the hole in the lever arm, whereby the pin is rotatably attached to the lever arm.

6. The tackling dummy system of claim 1 wherein the longitudinal member has a plurality of lower flanges, and wherein the carriage comprises:

a body having a plurality of holes therein;

a plurality of wheels which ride along the lower flanges, each wheel having a hole therein; and a plurality of axles inserted into the holes in the body and into the holes in the plurality of wheels, whereby the wheels are rotatably attached to the body.

7. The tackling dummy system of claim 1, wherein the hanger is a locking swivel.

8. A tackling dummy system, comprising:

a first plurality of support posts;

a first cross-member supported by the first plurality of support posts;

a second plurality of support posts;

a second cross-member supported by the second plurality of support posts;

a long beam attached to and supported by the first and second cross-members, the long beam having a first section and second section, the second section being at a first inclined angle with respect to the first section, the long beam having upper flanges and lower flanges, at least one upper flange having a plurality of holes;

a carriage, the carriage having a body and a plurality of wheels attached thereto by a plurality of axles, the plurality of wheels riding on the lower flanges of the long beam;

a release mechanism, the release mechanism comprising a handle connected to a lever arm assembly by a connecting wire, and a pin connected to the lever arm assembly and movably inserted into a hole of the plurality of holes of the upper flange to prevent the carriage from moving in a predetermined direction on the long beam, whereby the release mechanism at least partially retracts the pin when the handle is pulled to allow the carriage to move on the long beam in the predetermined direction;

a tackling dummy having at least one void therein to accommodate a ball; and a locking swivel to connect the tackling dummy to the carriage, the locking swivel causing the dummy to preferentially face in a predetermined direction.

9. The tackling dummy system of claim 8, wherein the tackling dummy has a torso and the at least one void is on one side of the torso and a second void on the other side of the torso, the second void being configured to retain a ball or allow an arm to be inserted therein.

10. The tackling dummy system of claim 8, wherein the tackling dummy has a torso and the at least one void is on one side of the torso to retain a ball, and a second void on the other side of the torso, and an arm, the arm being at least partially inserted into the second void.

11. The tackling dummy system of claim 10, wherein the arm is a forwardly-projecting arm.

12. The tackling dummy system of claim 8, wherein the dummy comprises a punching bag and a cover for the punching bag, the cover being configured to include at least one void.

13. The tackling dummy system of claim 8, wherein the tackling dummy has a torso and handles on the rear side of the torso.

14. The tackling dummy system of claim 8, wherein the weight of the tackling dummy is in the range of 100 to 250 pounds.

15. The tackling dummy of claim 8, wherein the weight of the tackling dummy is approximately 200 pounds.

16. The tackling dummy system of claim 8, wherein the at least one void is of a shape and dimensions to retain a football.

* * * * *